United States Patent [19]

Paul

[11] Patent Number: 4,820,001

[45] Date of Patent: Apr. 11, 1989

[54] FILE DRAWER DIVIDERS

[76] Inventor: Bernard Paul, 350 E. Tioga St., Philadelphia, Pa. 19134

[21] Appl. No.: 170,126

[22] Filed: Mar. 14, 1988

Related U.S. Application Data

[63] Continuation of Ser. No. 4,890, Jan. 20, 1987, abandoned.

[51] Int. Cl.[4] ..... A47B 63/00

[52] U.S. Cl. ..... 312/183; 312/330 R

[58] Field of Search ..... 206/813, 425, 560; 220/20, 22, 23.4; 229/9, 19; 211/71, 131; 312/248, 183, 259, 260, 261

[56] References Cited

U.S. PATENT DOCUMENTS

| | | | |
|---|---|---|---|
| 1,253,489 | 1/1918 | Houghland | 229/9 |
| 1,430,043 | 9/1922 | Wagemaker | 220/22 |
| 2,435,151 | 1/1948 | Morgan | 312/248 |
| 3,892,348 | 7/1975 | Rohner | 312/259 X |
| 3,957,320 | 5/1976 | Walter | 312/259 X |
| 4,145,100 | 3/1979 | Klaus | 312/183 X |

FOREIGN PATENT DOCUMENTS

| | | | |
|---|---|---|---|
| 2353549 | 4/1975 | Fed. Rep. of Germany | 312/183 R |

*Primary Examiner*—Joseph Falk

*Attorney, Agent, or Firm*—Steele, Gould & Fried

[57] ABSTRACT

A file drawer divider system is disclosed which includes a plurality of similar, upwardly and downwardly open, folded, corrugated board blanks. The blanks are folded and taped to define a plurality of rectangular cross sectional areas to receive and store cardboard files therewithin. Sufficient dividers are placed in each file drawer in longitudinal juxtaposition to substantially fill the file drawer to maintain the stored files in upright and subdivided relationship.

1 Claim, 2 Drawing Sheets

FILE DRAWER DIVIDERS

This is a continuation of application Ser. No. 004,890, filed on Jan. 20, 1987, now abandoned.

BACKGROUND OF THE INVENTION

1. Field of the Invention

The present invention relates generally to the field of office file equipment, and more particularly, is directed to a novel, inexpensive and easily installed divider system for use with existing file drawers.

2. Description of the Prior Art

It is currently the common practice in offices and other establishments wherein quantities of documents and other written materials are generated and must be maintained to store such materials in vertical orientation within drawers or shelves contained within metallic or other file cabinets. Usually, the file drawers are movable between closed and open positions so that workers can gain ready access to the filed materials.

Most often, the file papers are maintained within light cardboard file folders, and these folders in turn are stored within the file drawers in a pre-selected arrangement to provide ready access and ready retrieval of the stored papers. In other systems, the stored papers are maintained directly within hanging type folders and these folders in turn are supported by a pair of transversely spaced rails. The space rails are generally attached directly to the sides of the file drawers for file hanging purposes by the manufacturer. Alternately, the spaced side rails can be purchased separately from the file cabinet and can be installed in a relatively easy manner by the user. One popular hanging file system has been extensively advertised and sold under the trademark "Pendaflex".

While the prior art systems generally perform satisfactorily and serve the purposes for which they have been designed, experience has shown that the light cardboard folder file system sometimes proves inadequate because the files have a tendency to bend or to become too tightly wedged within the drawer for efficient use. The hanging type filing systems generally alleviate the wedging and bending problems that are inherent when using only the cardboard file folders. However, it has been found that such systems are quite expensive in initial costs and thereby detract from the general availability of such systems under all conditions of use. The instant invention seeks to overcome all of the drawbacks that are present in the prior art filing systems by providing a simple, inexpensive, sturdy and easily employed file drawer divider system that is substantially universally adaptable to all file drawers.

SUMMARY OF THE INVENTION

The present invention relates generally to a divider system for file drawers, and more particularly, is directed to an extremely simple, modular corrugated board divider of width to conveniently fit within the file drawer in a manner to maintain a plurality of files in upright orientation.

In accordance with the teachings of the present invention, a corrugated board blank is folded to a rectangular cross-sectional configuration of width suitable to transversely fit within a usual file cabinet drawer. In the case of letter size files, it is contemplated that the largest dimension of the divider will be approximately twelve inches. In the case of legal size files, it is contemplated that the largest dimension of the divider will be approximately fifteen inches. It will be appreciated of course that the length of the divider can be designed to any convenient or desired length as may be necessary to easily fit within a conventional file cabinet or other file storage drawer.

The divider of the present invention is preferably formed of a cut and scored elongate blank of corrugated board which is first folded along the score lines to the desired cross-sectional configuration and then the ends are taped or otherwise secured in well known manner. After a plurality of blanks have been folded into rectangular cross-sectional configurations, and the ends properly taped or otherwise joined, the plurality of blanks can then be placed within a file drawer in face to face juxtaposition to essentially divide the file drawer into a number of subdivisions equal to the number of dividers employed. After the dividers have been placed within the file drawer, then conventional cardboard files containing letters, memorandum and other paper materials can be placed within the dividers which then act to hold the files in substantially vertical alignment within the file drawer. If desired, separate cardboard dividers can be employed between one or more of the folded dividers to thereby delineate various subdivisions as may be desired by the user.

It is noteworthy that each file drawer divider, after being formed from the folded and taped blank, defines a hollow compartment of rectangular cross-section which is delineated by interconnected front, rear and side walls and which is further characterized by both an open top and an open bottom. Accordingly, the dividers of the present invention are not suitable for independent use outside of a file drawer inasmuch as any papers or files positioned within the hollow interior of the divider would simply slide through and would not be retained or supported in any manner. Only when the dividers are positioned within a file drawer can the dividers be used inasmuch as the bottom of the file drawer serves to receive the bottoms of the dividers and the bottoms of the stored files and thereby prevents any files from slipping past the divider bottom.

It is therefore an object of the present invention to provide an improved file drawer divider of the type set forth.

It is another object of the present invention to provide a novel file divider which may be inexpensively and easily formed of a cut and scored corrugated board blank.

It is another object of the present invention to provide novel file drawer dividers suitable for placement within a file drawer in face to face juxtaposition to maintain a plurality of file folders in an upright, neat and sub-divided arrangement.

It is another object of the present invention to provide a novel file drawer divider which is generally rectangular in cross-sectional configuration and which is intended for placement in multiples within a file drawer to receive and maintain a plurality of file folders in vertical, longitudinally juxtaposed relationship.

It is another object of the present invention to provide novel file drawer dividers that are simple in design, inexpensive in manufacture and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

DESCRIPTION OF THE PREFERRED EMBODIMENT OF THE INVENTION

Figure 1:
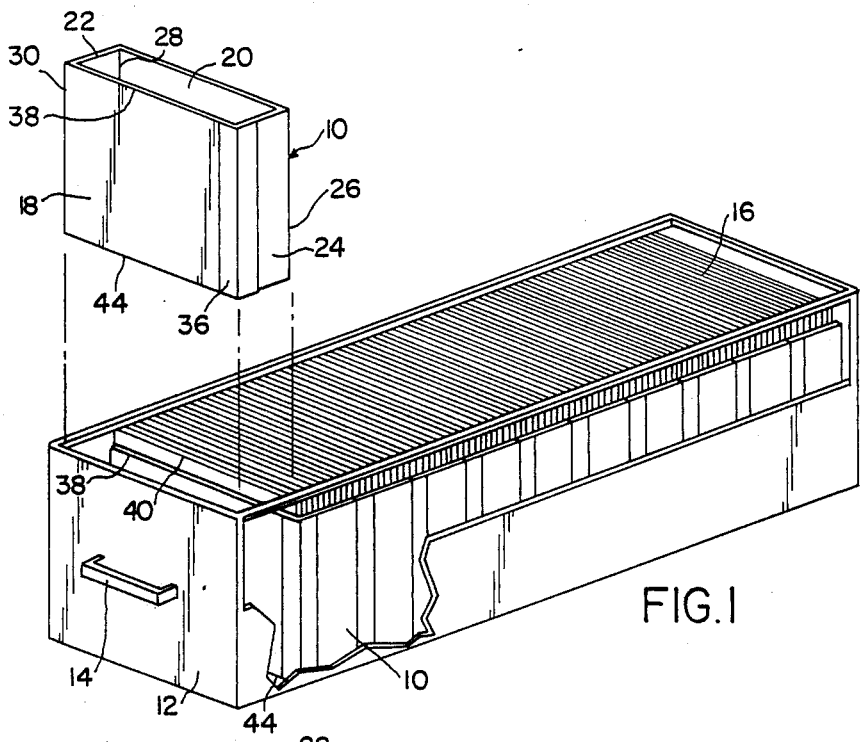
FIG. 1 is a perspective, partially exploded view of the dividers of the present invention applied within a file drawer, with portions of the file drawer broken away to expose interior construction features.

Although specific terms are used in the following description for the sake of clarity, these terms are intended to refer only to the particular structure of the invention selected for illustration in the drawings, and are not intended to define or limit the scope of the invention.

Figure 2:
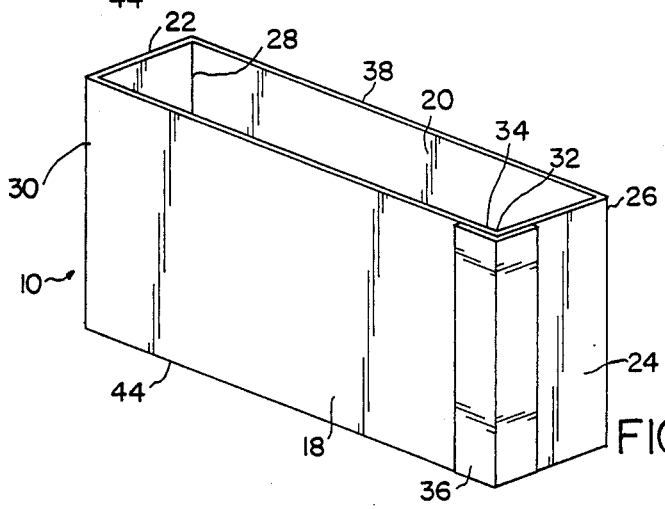
FIG. 2 is an enlarged, perspective view of one of the file drawer dividers illustrated in FIG. 1.

Turning now to the drawings, there is shown in FIGS. 1 and 2 a divider 10 suitable for use within a conventional file drawer 12 to support a plurality of light cardboard files 16 in generally upright, vertical condition. As illustrated, it is intended to provide a plurality of dividers 10 in longitudinally juxtaposed position within the file drawer 12 to thereby provide a plurality of spaced supports for a plurality of conventional, cardboard or manila folders or files 16. As best seen in FIG. 1, it will be noted that the dividers 10 are positioned in face to face relationship within the file drawer 12 and substantially fill the entire interior area of the drawer.

Accordingly, when one or more of the individual files 16 is withdrawn from the file drawer 12 for use in the usual manner, the plurality of dividers 10 which are positioned within the drawer 12 serve to maintain the remainder of files in their existing, upright condition. When it is time to replace the withdrawn files 16, the dividers tend to act as spacers to facilitate the reinsertion of the withdrawn files into their original, predetermined locations. As best seen in FIG. 1, it is contemplated that each of the plurality of dividers 10 will be similar in configuration and that the dividers will fill the entire interior area defined by the flel drawer to thereby provide a plurality of longitudinally subdivided, equal spaces for receipt of the individual files 16 therewithin.

Figure 3:
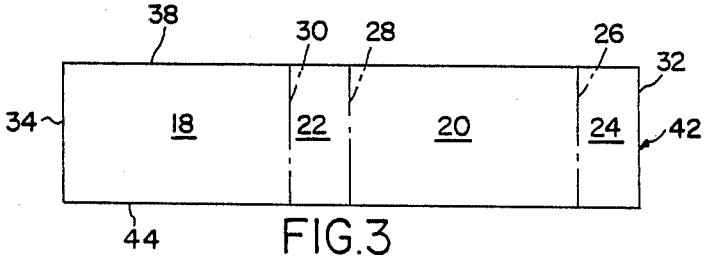
FIG. 3 is a top plan view on reduced scale of a corrugated board blank prior to being folded and taped into a divider.

As best seen in FIGS. 2 and 3, each divider 10 is similarly formed of a cut and scored blank 42 and is folded to define a plurality of vertically open file receiving areas which are longitudinally spaced within the interior of the file drawer 12. Each blank 42 may be conventionally cut or otherwise formed of corrugated board to the predetermined dimensions and is scored in known manner to develop the final divider cross-sectional configuration. The blank 42 is cut to a rectangular configuration to define a straight top 38, a staight bottom 44 with opposed ends 32, 34. Score or fold the lines 26, 28, 30 are provided to define the narrow ends or side panels 22, 24 from the wider front and rear panels 18, 20. Preferably, the front and rear panels 18, 20 are fabricated to be at least three times as long as the side panels 22, 24 to form a sturdy, self supporting structure suitable to maintain a plurality of files 16 therewithin.

By bending along the fold or score lines 26, 28, 30, the lateral ends 32, 34 of the blank 42 can be brought into edge to edge juxtaposition and can be easily secured together by employing a vertical length of tape 36 which may be glued to the adjacent portions of the front panel 18 and the end panel 26 in the manner illustrated in FIGS. 1 and 2. It will be appreciated that a plurality of dividers 10 can be formed in the manner illustrated in FIGS. 2 and 3 and then be stored in flat configuration to conserve storage space by folding along opposite fold or score lines 26, 30 or along the fold line 28 and the opposite joined blank ends 32, 34. When it is desired to use the stored and folded dividers 10, it is a relatively simple matter to manipulate each divider 10 as necessary to provide substantially right angles between the adjacent blank end or side panels 22, 24 and the adjacent blank front and rear panels 18, 20.

In use, each file drawer 12 in turn is pulled to its open position by utilizing the conventional file drawer handle 14 to thus expose the interiors of the file drawers. Once the file drawers are opened, a plurality of dividers 10 should each first be unfolded and manipulated as necessary to define rectangular cross-sectional configurations. See FIG. 1. With the dividers configured as illustrated in FIGS. 1 and 2, a plurality of such dividers are then placed within each file drawer 12 in longitudinally spaced relationship. Sufficient dividers 10 are employed with each file drawer 12 to substantially subdivide the entire longitudinal area encompassed within the file drawer into a plurality of similar, longitudinally juxtaposed, upwardly open, file receiving compartments. With the number of dividers 10 so positioned, the file drawer can then be readily utilized to receive and store a plurality of conventional manila folders or files 16 in relatively upright, controlled, vertical condition. Each divider 10 serves to maintain and support the files 16 retained therein individually, without interference or obstruction with the other files and dividers stored within the file drawer.

It is noteworthy when observing the dividers 10 as illustrated in FIGS. 1 and 2 that the front and rear panels 18, 20 together with the joined end or side panels 22, 24 define a file receiving area of substantially rectangular cross-sectional configuration. The dividers terminate upwardly in a planar top 38 and downwardly in a planar bottom 44, which tops and bottoms define respective upper and lower rectangular openings. Accordingly, the files 16 are not vertically restrained by the dividers 10, but rather, the floor of the file drawer is utilized for this purpose. The dividers 10 themselves only serve to maintain the files in an upright and neat position.

Figure 4:
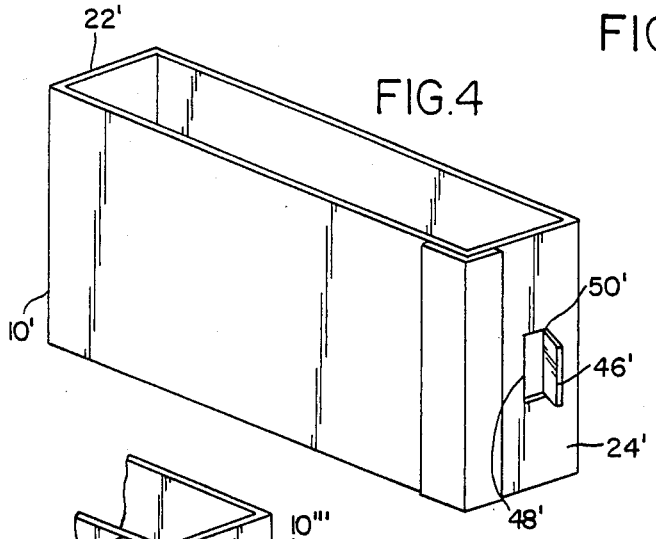
FIG. 4 is a perspective view of a modified embodiment of a file drawer divider.
Figure 5:
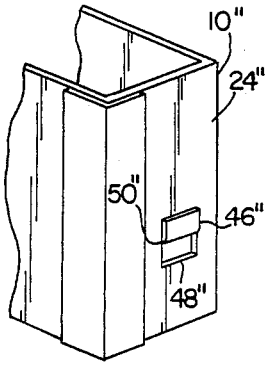
FIG. 5 is a partial, perspective view of another embodiment of the file drawer divider.
Figure 6:
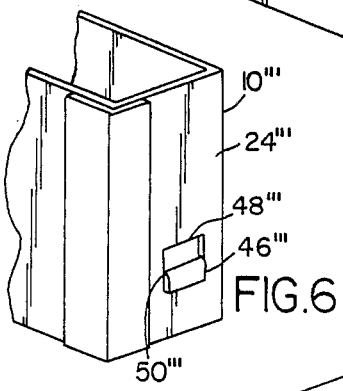
FIG. 6 is a partial, perspective view of another embodiment of the file drawer divider.

Referring now to FIGS. 4, 5 and 6, modified embodiments 10', 10'' and 10''' of the file drawer divider are illustrated. Each of the modified dividers 10', 10'', 10''' is constructed similarly to the construction of the divider 10 as previously described with the exception that the respective right side plates 24', 24'', 24''' and left side panels 22′ (only visible in FIG. 4) are provided with laterally extendible tabs or locks 46′, 46″, 46‴. Each tab or lock 46′, 46″, 46‴ is die cut or otherwise formed in a respective file drawer divider side 24′, 24″, 24‴ and is defined by a generally U-shaped cut 48′, 48″, 48‴ and a linear fold line 50′, 50″, 50‴, which fold line traverses between and intersects the open ends of a respective U-shaped cut.

Figure 1A:
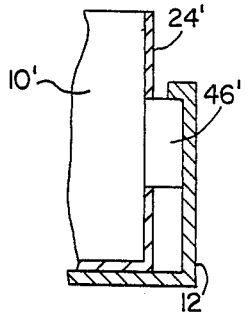
FIG. 1A is a partial, cross sectional view of the embodiment of FIG. 4, showing the locking tab engaged upon a portion of the file drawer side construction.

In use, the modified embodiments 10′, 10″, 10‴ can be placed in a file drawer 12 in the manner illustrated in FIG. 1 and then the respective tabs or locks 46′, 46″, or 46‴ can be urged or pushed laterally outwardly by bending about a respective fold line 50′, 50″, or 50‴. The outwardly extending locks 46′, 46″, or 46‴ are positioned to engage in the existing grooves or tracks which are normally bent in the file drawer sides at time of manufacture. The interengagement of the divider locks 46′, 46″, or 46‴ with the file drawer sides will function to prevent unwanted upward displacement of one or more dividers when the files 16 are upwardly pulled or removal from the file drawer. See FIG. 1A.

Figure 7:
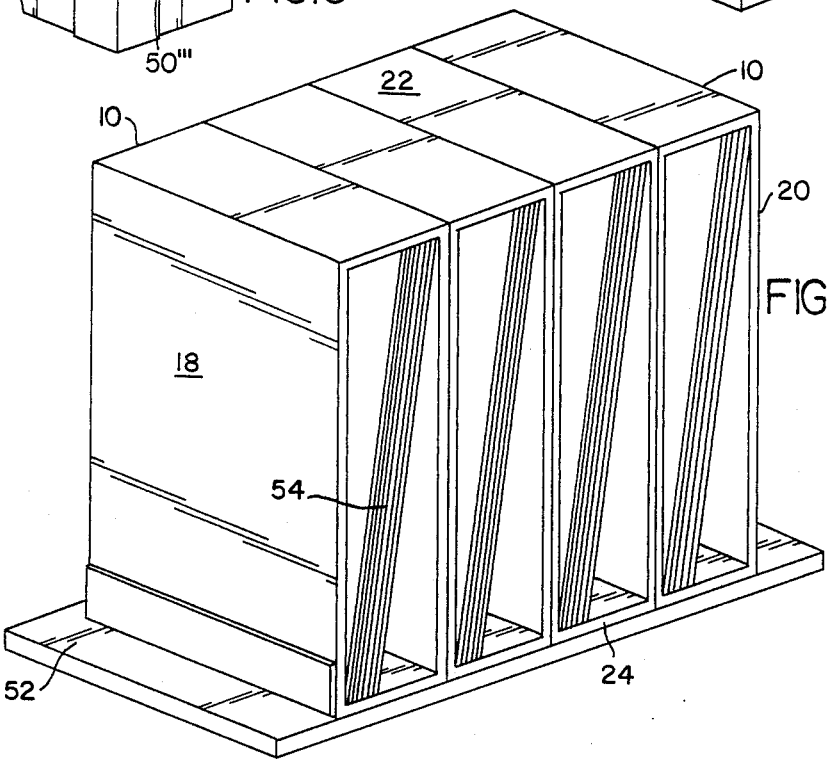
FIG. 7 is a perspective view of a plurality of dividers arranged in side by side relationship upon a supporting shelf.

Referring now to FIG. 7, a plurality of file drawer dividers 10 are supported upon a shelf 52 or other horizontal surface with their respective front and rear panels 18, 20 oriented vertically and with their respective side panels 22, 24 oriented horizontally. In the arrangement as illustrated, the dividers 10 can be conviently employed to support in easily accessible arrangement a plurality of loose pamphlets, papers or other planar materials 54. As shown, the dividers 10 are generally self supporting with the front panel 18 of one divider in overall face to face contact with the rear panel 20 of the next adjacent divider 10. In this manner, the divider constructions can be usefully employed without being positioned within a file drawer.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. The combination of a file drawer of the type having a floor, front and rear walls and left and right sidewalls extending upwardly from the floor for storing a plurality of the file folders and a plurality of similar, separate, discreet self supporting dividers movably supported within said file drawer, one said wall of said file drawer having an inwardly extending flange, each said divider comprising a folded blank of cut and scored corrugated board material, the blank being folded to define a front panel, a rear panel, a right side panel and a left side panel, the folded blank having no top panel and no bottom panel, the said panels defining a file folder receiving area of rectangular cross-sectional configuration therewithin, a strip of tape joining the adjacent edges of two of the panels to maintain said rectangular configuration, one said panel of the folded blank being provided with a U-shaped cut to define an extended tab, the tab being positioned on said panel to extend beneath said flange for preventing upward displacement of said divider in said file drawer, each divider being freely movable over the floor of the file drawer for supporting file folders in selected positions within the file drawer, each file folder receiving area comprising an unrestricted open top and an unrestricted open bottom, the open bottom of the file folder receiving area being positioned immediately above the file drawer floor, whereby the file folders are maintained in upright position within the file folder receiving area while the file folders themselves rest directly upon the file drawer floor.

* * * * *

UNITED STATES PATENT AND TRADEMARK OFFICE

CERTIFICATE OF CORRECTION

PATENT NO. : 4,820,001

DATED : April 11, 1989

INVENTOR(S) : Bernard Paul

It is certified that error appears in the above-identified patent and that said Letters Patent is hereby corrected as shown below:

In Column 3, line 59, change "flel" to --file--.

Signed and Sealed this

Twenty-second Day of May, 1990

*Attest:*

HARRY F. MANBECK, JR.

*Attesting Officer*

*Commissioner of Patents and Trademarks*